US006648359B2

(12) United States Patent
Chen et al.

(10) Patent No.: US 6,648,359 B2
(45) Date of Patent: Nov. 18, 2003

(54) ADJUSTABLE CONNECTION DEVICE FOR CONNECTING PARTS OF WHEEL CHAIRS

(75) Inventors: Zen-Jye Chen, Taichung (TW); Wen-Huei Chung, Taichung (TW); Ju-Pin Li, Taichung (TW)

(73) Assignee: Aerospace Industrial Development Corporation, Taichung (TW)

( * ) Notice: Subject to any disclaimer, the term of this patent is extended or adjusted under 35 U.S.C. 154(b) by 0 days.

(21) Appl. No.: 10/205,465

(22) Filed: Jul. 26, 2002

(65) Prior Publication Data

US 2003/0189311 A1 Oct. 9, 2003

(30) Foreign Application Priority Data

Apr. 3, 2002 (TW) ..... 91204451 U

(51) Int. Cl.[7] ..... A47C 7/54

(52) U.S. Cl. ..... 280/304.1; 248/118.3; 297/411.35

(58) Field of Search ..... 280/304.1, 250.1; 248/118, 118.1, 118.3, 292.12; 297/411.35, 411.36, 411.37, 115, 116, 117

(56) References Cited

U.S. PATENT DOCUMENTS 2,622,831 A * 12/1952 Fullwood ..... 248/292.12
3,883,175 A * 5/1975 Rodaway ..... 297/411.28
5,255,956 A * 10/1993 Stevens ..... 297/411.26
2002/0024196 A1 * 2/2002 Malassigne et al. ..... 280/648

* cited by examiner

*Primary Examiner*—Kevin Hurley
(74) *Attorney, Agent, or Firm*—Rosenberg, Klein & Lee

(57) ABSTRACT

A wheel chair includes two side assemblies each include a back post with a hand grip, a seat bar connected to a lower end of the back post, an arm rest movably connected to the back post, a hanger bracket connected to a front end of the seat bar, a caster rotatably connected to a front end of the seat bar, and a rear wheel connected to a side of the side assembly. A connection device connects the back post and the arm rest, or the front end of the seat bar and the hanger bracket. The connection device has a C-shaped member fastened on the back post or the front end of the seat bar extends. A sleeve is connected to an outside of the C-shaped member and a first end of a connection tube is movably and rotatably received in the sleeve. A locking bolt extends through a close end of the sleeve and is threadedly connected to the first end of the connection tube. The arm rest or the hanger bracket is fixedly connected to a second end of the connection tube.

6 Claims, 7 Drawing Sheets

ADJUSTABLE CONNECTION DEVICE FOR CONNECTING PARTS OF WHEEL CHAIRS

FIELD OF THE INVENTION

The present invention relates to a wheel chair wherein the parts of the wheel chair are connected by connection devices which allow the tubular parts to be adjustable in different directions.

BACKGROUND OF THE INVENTION

A conventional wheel chair generally includes a seat portion and a backrest connected between two side assemblies and each of the side assemblies has a caster rotatably connected to a front end thereof and a rear wheel connected to a side of a rear end of each side assembly. The side assemblies each comprise a plurality of tubes that are welded together so that they cannot be moved or adjusted with each other. In other words, the conventional wheel chair provides less flexibility of options for different users who could be tall or short. Some wheel chairs have adjustable devices to meet the needs of different users, however, the adjustable devices are complicated and can only provide limited options which are not satisfied by the users.

SUMMARY OF THE INVENTION

In accordance with one aspect of the present invention, there is provided a wheel chair which comprises two side assemblies each have a back post, a seat bar connected to a lower end of the back post, an arm rest movably connected to the back post by a connection device, a hanger bracket connected to a front end of the seat bar, a caster rotatably connected to a front end of the seat bar and a rear wheel connected to a side of the side assembly.

The connection device has a C-shaped member mounted to the back post. Two lugs respectively extend from two ends of the C-shaped member and a bolt extends through the two lugs.

A sleeve is connected to an outside of the C-shaped member and a first end of a connection tube is movably and rotatably received in the sleeve from an open end of the sleeve. A locking bolt extends through a close end of the sleeve and is threadedly connected to the first end of the connection tube. The arm rest is fixedly connected to a second end of the connection tube.

The primary object of the present invention is to provide a connection device for a wheel chair and the device allows the arm rest or the hanger bracket to be adjusted in three directions.

The present invention will become more obvious from the following description when taken in connection with the accompanying drawings which show, for purposes of illustration only, a preferred embodiment in accordance with the present invention.

BRIEF DESCRIPTION OF THF DRAWINGS

DETAILED DESCRIPTION OF THE PREFERRED EMBODIMENTS

Figure 1:
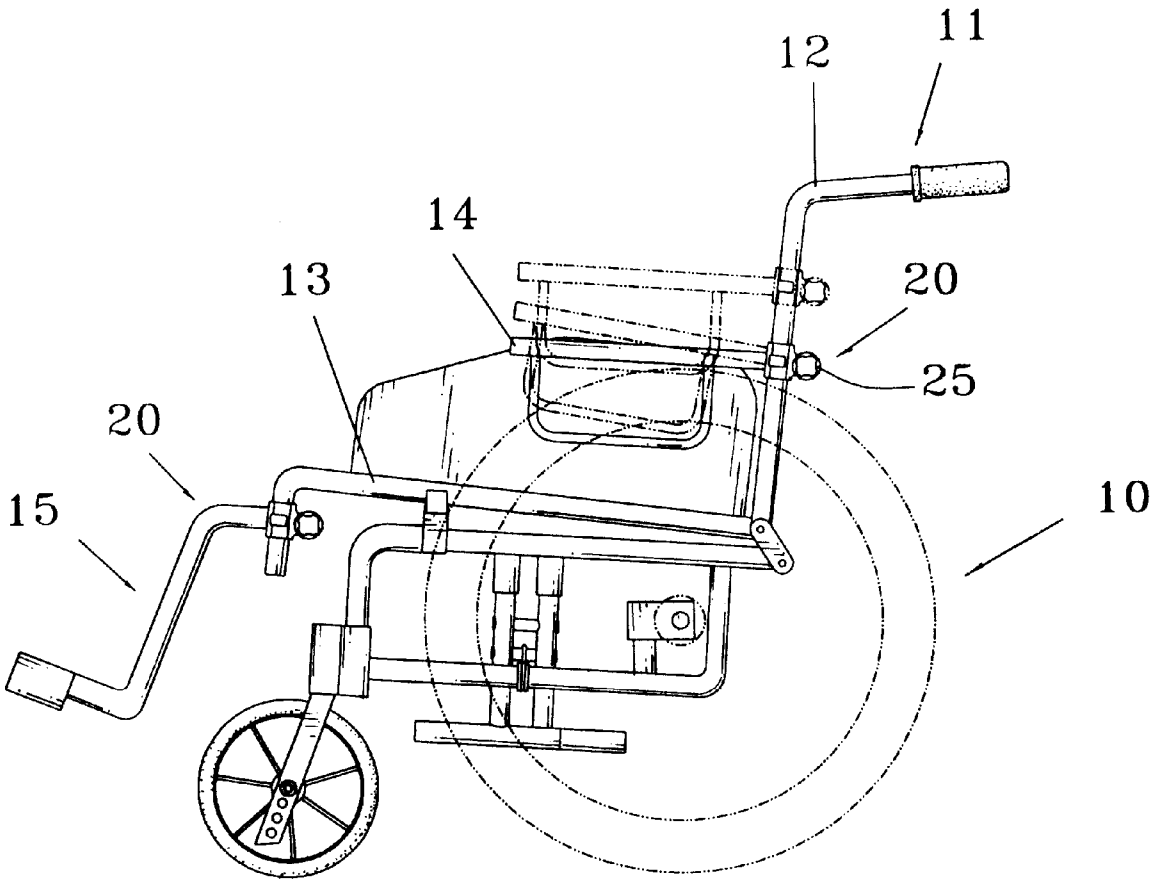
FIG. 1 is a side view to show the wheel chair of the present invention and the arm rests are movable.
Figure 2:
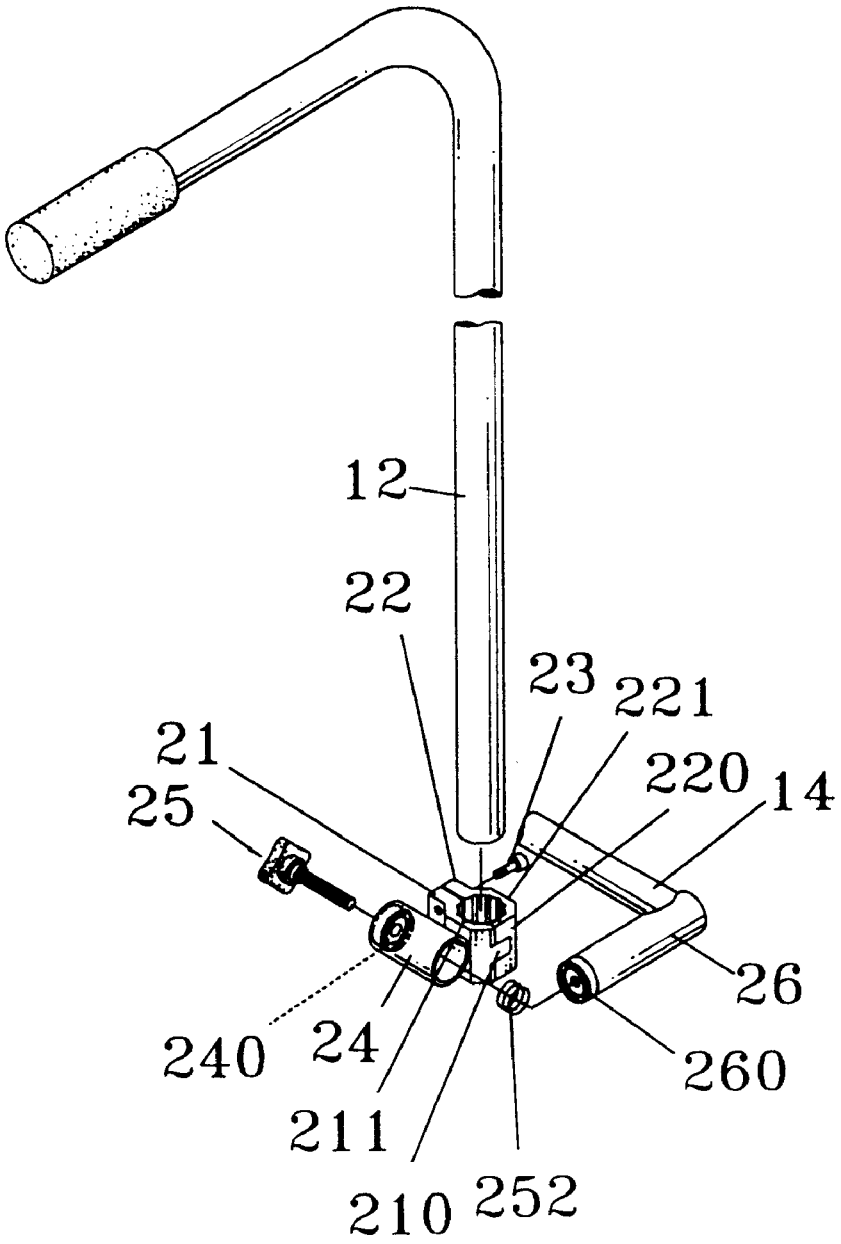
FIG. 2 is an exploded view to show the connection device for connecting the back post and the arm rest of the wheel chair of the present invention.
Figure 3:
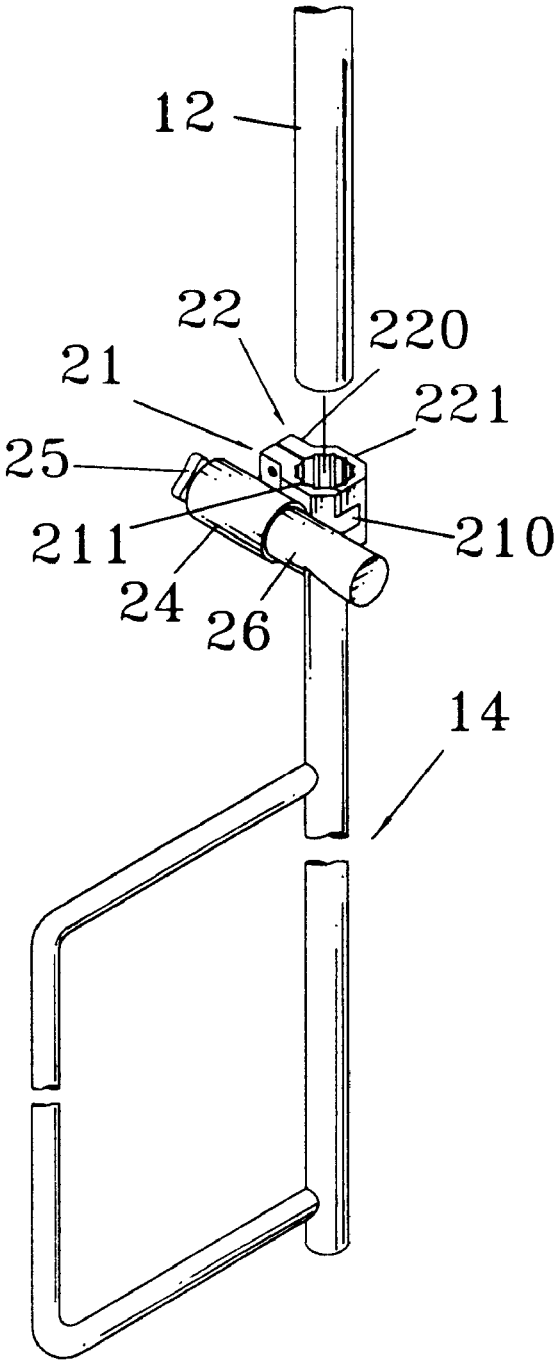
FIG. 3 shows the connection device mounted onto the back post of the wheel chair of the present invention.
Figure 4:
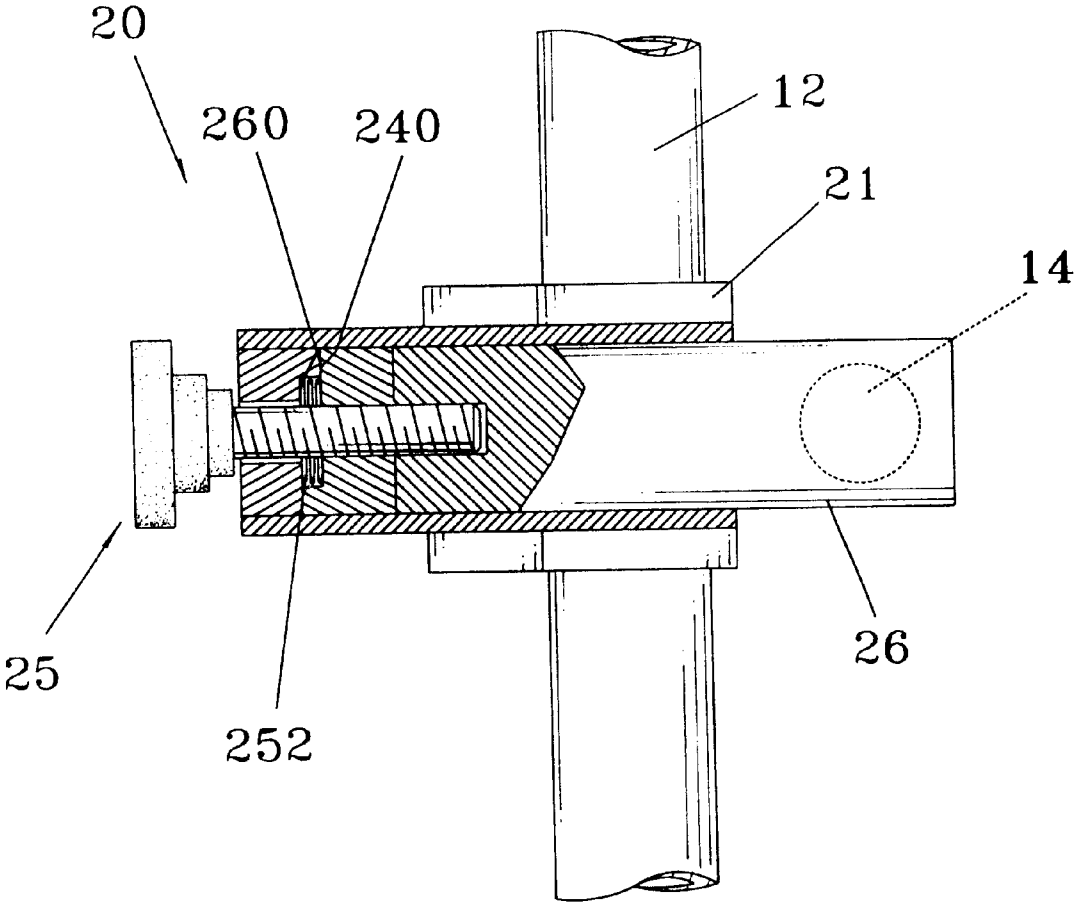
FIG. 4 shows a cross sectional view of the connection device of the wheel chair of the present invention.
Figure 5:
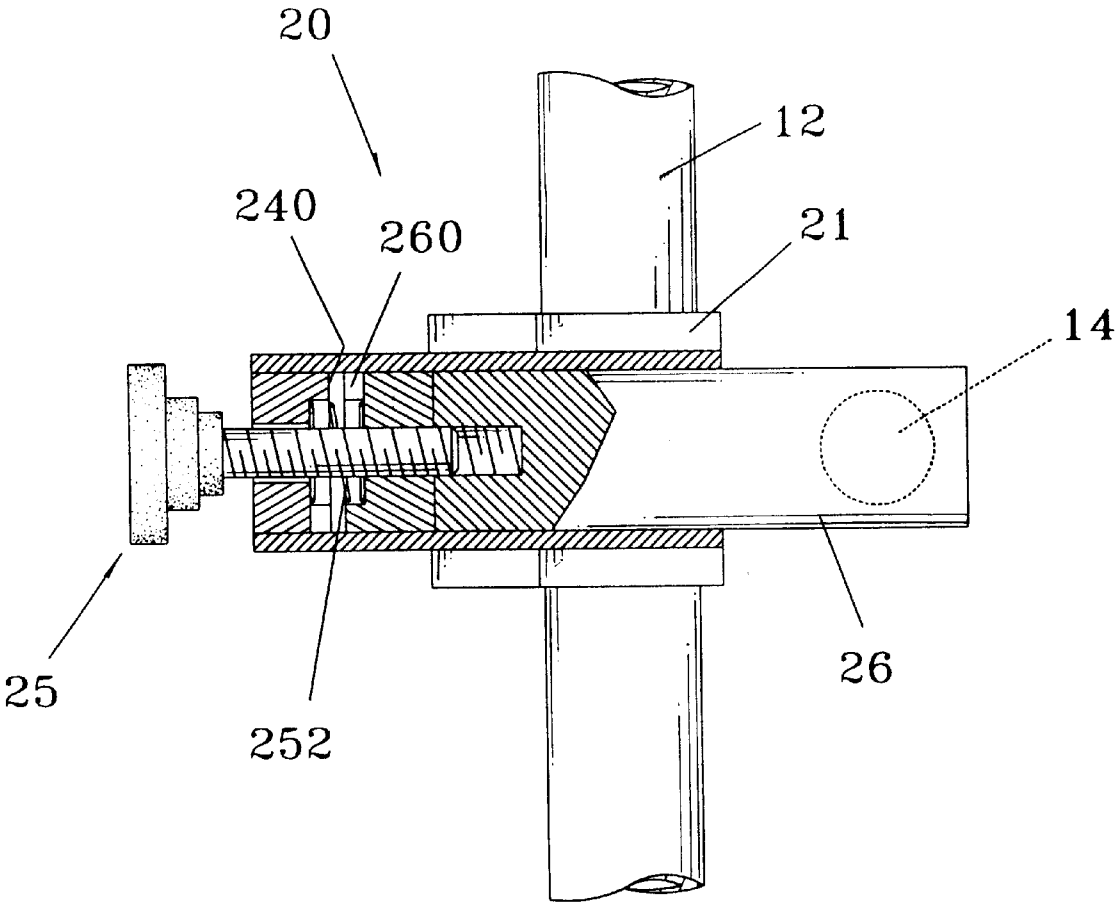
FIG. 5 shows that the locking bolt is unscrewed and the connection tube is pulled away from the sleeve

Referring to FIGS. 1 to 4, the wheel chair of the present invention comprises two side assemblies each comprise a back post 12 and a hand grip 11 connected thereto. A seat bar 13 is connected to a lower end of the back post 12 and a seat upholstery is connected between the two seat bars 13. An arm rest 14 is movably connected to the back post 12 by a connection device 20. A hanger bracket 15 with a foot plate is connected to a front end of the seat bar 13 by the other connection device 20. A caster is rotatably connected to a front end of the seat bar 13 and a rear wheel is connected to a side of the side assembly.

The connection device 20 has a C-shaped member fastened to the back post 12, two lugs 21, 22 respectively extending from two ends of the C-shaped member and a bolt 23 extending through the two lugs 21, 22 to securely fasten the C-shaped member onto the back post 12. The C-shaped member is composed of two parts 221, 211 which are pivotably connected with each other by an engagement of a convex 20 and a concave 220 at the opposite end of the lugs 21, 22.

A sleeve 24 is connected to an outside of the C-shaped member and a first end of a connection tube 26 is movably and rotatably received in the sleeve 24 from an open end of the sleeve 24. A locking bolt 25 extends through a close end of the sleeve 24 and is threadedly connected to the first end of the connection tube 26. The arm rest 14 is fixedly connected to a second end of the connection tube 26.

An inside of the close end of the sleeve 24 has a serrated surface 240 and the first end of the connection tube 26 has a serrated surface 260 which is engaged with the serrated surface 241 of the sleeve 24. A spring 252 is mounted to the shank of the locking bolt 25 and biased between an inside of the close end of the sleeve 24 and the first end of the connection tube 26. The spring 252 exerts a force pushes the connection tube 26 away from the sleeve 24

The C-shaped member can be moved on the back post 12 by loosening the bolt 23 so that the height of the arm rest 14 can be adjusted. By loosening the locking bolt 25, the connection tube 26 and the arm rest 14 can be rotated about the axis of the sleeve 24. The C-shaped member may also be rotated about the axis of the back post 12 to have another position. Therefore, the connection device 20 allows the arm rest 14 to be adjusted in three directions.

Figure 6:
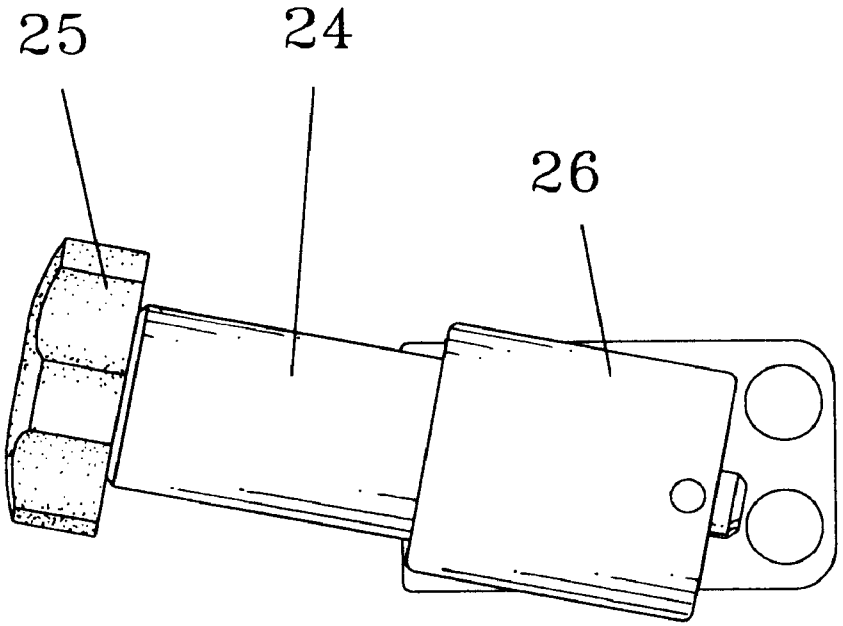
FIG. 6 shows that the sleeve and the connection tube are installed at angle relative to the C-shaped member of the connection device.

As shown in FIG. 6, the sleeve 24 and the connection tube 26 are also be able to be installed at angle relative to the axis of the C-shaped member according to needs.

The way that the connection device 20 connected between the front end of the seat bar 13 and the hanger bracket 15 is very much alike as described above for the connection device 20 connected between the back post 12 and the arm rest 14. In other words, the front end of the seat bar 13 is secured to the C-shaped member and the hanger bracket 15 is connected to the second end of the connection tube 26.

Figure 7:
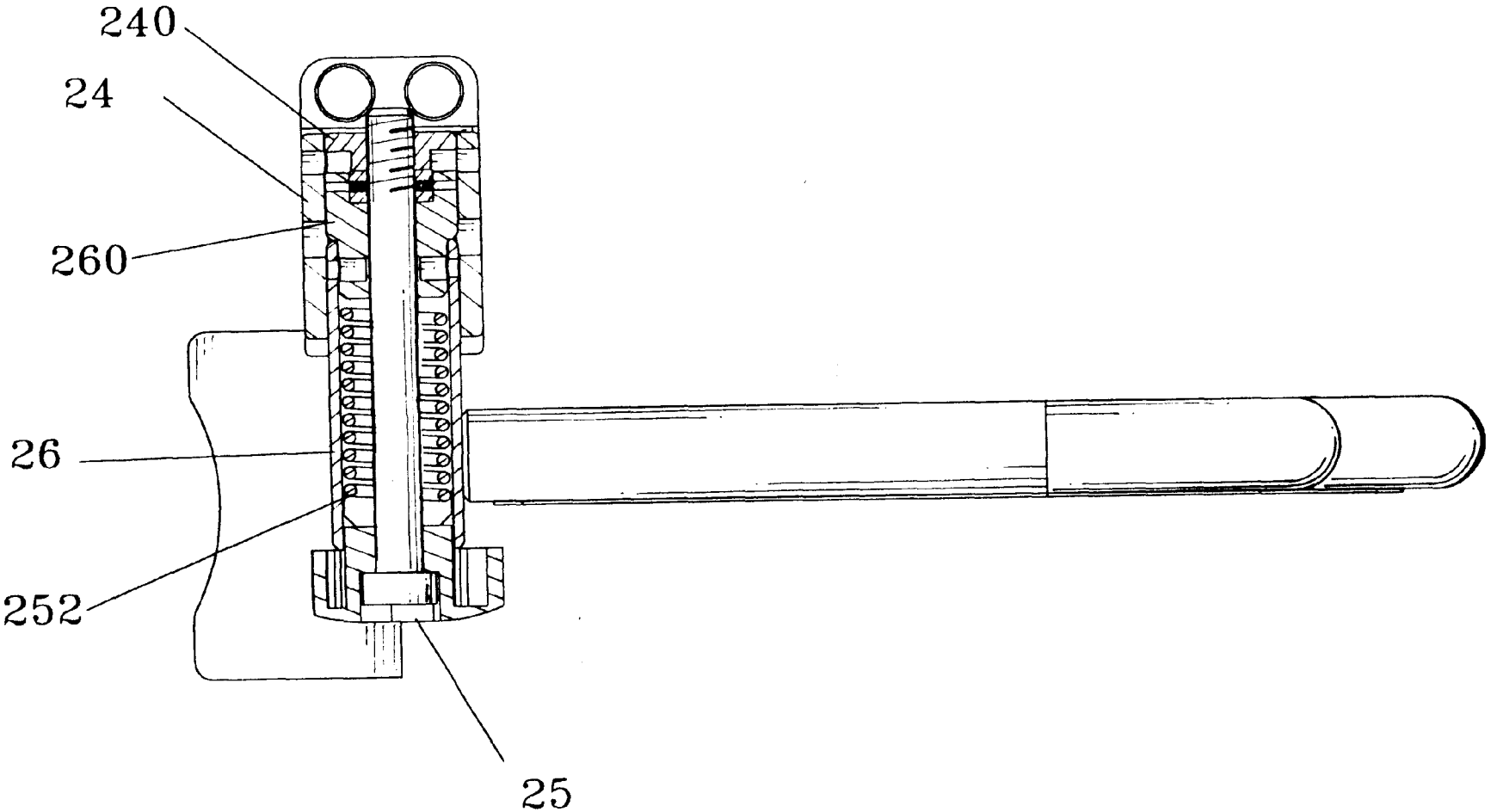
FIG. 7 shows the other embodiment of the connection device of the present invention.

FIG. 7 shows that the connection device may be designed to let the locking bolt 25 extend through the second end of the connection tube 26 and be engaged with an inside of the close end of the sleeve 24.

While we have shown and described the embodiment in accordance with the present invention, it should be clear to those skilled in the art that further embodiments may be made without departing from the scope of the present invention.

What is claimed is:

1. A wheel chair comprising:

two side assemblies each comprising a back post, a seat bar connected to a lower end of the back post, an arm rest movably connected to the back post by a connection device, a hanger bracket connected to a front end of the seat bar, a caster rotatably connected to a front end of the seat bar and a rear wheel connected to a side of the side assembly;

the connection device having a C-shaped member mounted to the back post, two lugs respectively extending from two ends of the C-shaped member and a bolt extending through the two lugs, and a sleeve connected to an outside of the C-shaped member and a first end of a connection tube movably and rotatably received in the sleeve from an open end of the sleeve, a locking bolt extending through a closed end of the sleeve and threadedly connected to the first end of the connection tube, the arm rest fixedly connected to a second end of the connection tube.

2. The wheel chair as claimed in claim 1, wherein an inside of the close end of the sleeve has a serrated surface and the first end of the connection tube has a serrated surface which is engaged with the serrated surface of the sleeve.

3. The wheel chair as claimed in claim 1, wherein a spring mounted to the locking bolt and biased between an inside of the close end of the sleeve and the first end of the connection tube.

4. A wheel chair comprising:

two side assemblies each comprising a back post, a seat bar connected to a lower end of the back post, an arm rest connected to the back post, a hanger bracket connected to a front end of the seat bar by a connection device, a caster rotatably connected to a front end of the seat bar and a rear wheel connected to a side of the side assembly;

the connection device having a C-shaped member mounted to the front end of the seat bar, two lugs respectively extending from two ends of the C-shaped member and a bolt extending through the two lugs, and a sleeve connected to an outside of the C-shaped member and a first end of a connection tube movably and rotatably received in the sleeve from an open end of the sleeve, a locking bolt extending through a closed end of the sleeve and threadedly connected to the first end of the connection tube, the hanger bracket fixedly connected to a second end of the connection tube.

5. The wheel chair as claimed in claim 4, wherein an inside of the close end of the sleeve has a serrated surface and the first end of the connection tube has a serrated surface which is engaged with the serrated surface of the sleeve.

6. The wheel chair as claimed in claim 4, wherein a spring mounted to the locking bolt and biased between an inside of the close end of the sleeve and the first end of the connection tube.

* * * * *